US005607727A

United States Patent [19]

Freeman et al.

[11] Patent Number: 5,607,727

[45] Date of Patent: Mar. 4, 1997

[54] COMPOSITION AND METHOD FOR CONTROLLING BROWN STAIN IN WOOD

[75] Inventors: Michael Freeman, Memphis, Tenn.; Terry Highley, Madison, Wis.; Elmer Schmidt, St. Paul, Minn.; Thomas Woods, Germantown, Tenn.

[73] Assignee: ISK Biosciences Corporation, Mentor, Ohio

[21] Appl. No.: 403,427

[22] Filed: Mar. 14, 1995

[51] Int. Cl.[6] ..... B05D 3/02

[52] U.S. Cl. ..... 427/393; 127/393.4; 127/440; 127/388.5; 127/397; 106/18.33; 106/287.3

[58] Field of Search ..... 427/393, 393.4, 427/439, 440, 388.4, 397, 421, 430.1, 388.5; 106/18.33, 287.3

[56] References Cited

U.S. PATENT DOCUMENTS

| | | | |
|---|---|---|---|
| 5,009,937 | 4/1991 | West et al. | 427/440 |
| 5,118,702 | 6/1992 | Wollweber et al. | 514/409 |
| 5,125,967 | 6/1992 | Morpeth et al. | 106/18.22 |
| 5,143,932 | 9/1992 | Jautelat et al. | 514/383 |
| 5,157,045 | 10/1992 | Hsu | 514/372 |
| 5,177,090 | 1/1993 | Diehr et al. | 514/363 |
| 5,185,357 | 2/1993 | Inui | 514/372 |
| 5,234,943 | 8/1993 | Heinemann et al. | 514/427 |
| 5,252,582 | 10/1993 | Jautelat et al. | 514/303 |
| 5,354,777 | 10/1994 | Wachtler et al. | 514/514 |
| 5,385,926 | 1/1995 | Ludwig et al. | 514/383 |

FOREIGN PATENT DOCUMENTS

| | | |
|---|---|---|
| 69303 | 3/1992 | Japan . |
| 4069303 | 3/1992 | Japan . |

OTHER PUBLICATIONS

E. Schmidt et al. "Trails of New Treatments for Prevention of Kiln Brownstain of White Pine (*Pinus Strobus*)", The International Research Group on Wood Preservation, Section 3, 26th Annual Meeting Jun. (1995).

B. Kreber, et al. "Discolorations of hem–fir wood: a review of the mechanisms", Forest Products Journal, vol. 44, No. 5, p. 35–42 May (1994).

B., Kreber "Advances n the understanding of hemlock Brownstain", pp. 18–36 May (1993).

*Primary Examiner*—Shrive Beck
*Assistant Examiner*—Brian K. Talbot
*Attorney, Agent, or Firm*—Thompson Hine & Flory LLP

[57] ABSTRACT

A composition for controlling brown stain in drying wood comprising chlorathalonil and methylene bisthiocyanate.

7 Claims, No Drawings

COMPOSITION AND METHOD FOR CONTROLLING BROWN STAIN IN WOOD

BACKGROUND OF THE INVENTION

The present invention relates to controlling brown stain in wood, and more particularly, this invention relates to the use of a combination of chlorothalonil and methylene bis-thiocyanate to control brown stain.

Typically, white pine (*Pinus strobus*), ponderosa pine, or western hemlock wood develops a brown stain, also known as coffee stain, on its surface due to oxidation during kiln drying. These stains greatly reduce the marketability of the lumber and necessitate downgrading the wood. The staining is most likely to occur when fresh, unseasoned lumber is stacked and stored for several days during warm or humid weather prior to kiln drying. Kiln-brown stain is thought to result as an enzymatic reaction involving a peroxidase and subsequent oxidation or polymerization of a leuco product in a two-step chemical process. High kiln temperatures cause polymerization and oxidation that produce colored compounds (tannins and phlobotanins). Peroxidase activity on phenolic extractives is apparently accelerated at the moisture and oxygen levels that occur in freshly sawn boards during such periods.

Prior art methods of combatting such stains for conifers have included mild kiln schedules and using reducing agents or pH alteration on the freshly cut lumber. Formerly, dip application of sodium azide and sodium fluoride were found to prevent kiln-brown stain. However, these compounds are toxic, and safety concerns have largely limited there use. Ammoniacal zinc oxide and several alkali salts were also shown to provide some control. Phosphoric acid and several 8-hydroxyquinoline compounds are environmentally acceptable and have been shown to control brown stain in sugar pine under laboratory conditions. However, as the compounds are largely toxic, dangerous, and possibly explosive under certain conditions and further some are not regulated by EPA, the search for a suitable stain control continues.

U.S. Pat. No. 5,009,937 to West et al. teaches a control for another kind of wood stain, specifically a sapstain control composition consisting of an aqueous solution of chlorothalonil and sodium tetraborate decahydrate (borax) in an amount 3 to 9 times greater than the amount of chlorothalonil.

Japanese Patent No. 04/069393 teaches a composition to control fungus which employs the combination of tetrachloro isophthalonitrile and at least one of methylenebisthiocyanate, 3-iodo-2-propynyl-n-butylcarbamate, or 2-methoxycarbonyl aminobenzimidazole.

Accordingly, there is a need for controlling brown stain, effectively using environmentally safe means. Further, there is a need for a superior system for the control of brown stain.

SUMMARY OF THE INVENTION

The present invention is a composition for controlling brown stain or coffee stain, during the drying of wood, such as the eastern white pine, all light colored conifers, specifically pine (*radiata*, eastern white chilean) and including hemlock and hem-fir. In a preferred embodiment of the invention, the composition includes a mixture of two biocides: tetra-chloroisophthalonitrile, also known as chlorothalonil, (CTL) and methylene bis-thiocyanate (MBT). The use of this composition has been shown to prevent or reduce the occurrence of brown stain.

Accordingly, it is an object of the present invention to provide a composition and method for controlling brown stain in drying wood; a composition and method which is safe to use; and a composition and method which is relatively inexpensive.

Other objects and advantages of the present invention will be apparent from the following description and the appended claims.

DETAILED DESCRIPTION

The combination of two fungicides, CTL and MBT provide unexpected good levels of control for brown stain in wood. It is shown to provide protection against both oxidative and fungal discoloration. The wood may be dipped in the composition of the present invention or the composition may be applied by spraying a liquid containing the composition on the wood.

The composition of the present invention is typically applied to the wood as a dispersion in water. To facilitate the use of the composition it is desirable to include in the dispersion in addition to the biocides, a defoamer, a thickener, dispersants and a carrier. While specific examples of these additives are illustrated in the following example, those skilled in the art will appreciate that equivalent materials can be substituted for those shown in the example. For example, other exemplary defoamers include polysiloxane and/or silicone oils. The amount of the defoamers will vary with the agent that is selected, but most are effective in an amount of 5 ppm to 2%.

The thickener is employed in an amount sufficient to prevent settling over extended periods of storage. An amount of 0.1% to 7% is effective. Other thickeners which can be used in the present invention include xanthan gum, kelp or seaweed derivatives and/or clays.

The dispersant is used in amount which provides excellent suspension of the active agents. This is typically 0.1% to 10%. Other dispersants can be used such as other nonionic, anionic, and blends of nonionic and anionic dispersants including nonyl-phenol etoxylates and napthlanene condensates.

The function of the carrier is as a solvent for the active mixture. Other suitable carriers include aromatic solvents, aliphatic solvents and parphinic oils. Typical amounts of carriers used are 0.1 to 4%.

Propylene glycol is used to provide dispersion stability. Other equivalents include other dicarbonyl water soluble solvents. Suitable amounts are 0.1 to 10%.

In one particular embodiment, the composition comprises:

13.96–15.44% Methylene-bis-thiocyanate
13.77–15.23% Chlorothalonil
1.12–1.37% Antifoam silicone as a defoamer
0.225–0.275% Xantham gum as a thickener
1.44–1.76% Sodium salt of polymeric acid as a dispersant
5.40–6.60% Nonylphenoxypoly ethanol as a carrier
4.50–5.50% Propylene glycol and 50.44–61.65% Water
(All measurements % by weight)

Wood is treated while green with the dispersion by dipping, spraying or pressure treating for 5 sec. to one hour, regardless of the treatment method.

It is preferable that the chlorothalonil be freshly ground and contain dispersants to aid in mixing with water and to prevent settling.

Typical kiln drying is known to those of skill in the art and is typically 4 hours to 4 days. A kiln schedule follows in the Example. The schedule is altered with changing moisture content.

EXAMPLE

Two old eastern white pine logs prone to brown stain were obtained from a commercial softwood mill. Boards 1 inch by 4 inches by 1 foot were cut from the logs. A fungicidal formulation was prepared having:

14.85% MBT (99%) from Albright & Wilson Ltd.
15.0% CTL (97% Technical Tuffgard) from ISK Biosciences Corp.
1.25% 1520 ANTIFOAM from Dow Corning Corporation
0.25% KELZAN Xantham gum from Kelco Division of Merck & Co.
1.60% TAMOL 731, 25% solution from Rohm & Hass
6.00% IGEPAL-CO-530 (Ethylenoxy) from Rhone-Poulene Inc.
5.00% Propylene Glycol
56.05% Water Boards or logs were dipped in the fungicide formulation for 10 sec. or 1 min. and 0.3% active ingredient. They were then drained and stored close-piled at 80° F. and 95% relative humidity for one week prior to drying. These conditions optimize enzymatic formation of the leuco precursor responsible for brown stain development.

The white pine lumber was kiln dried by a normal or an anti-brown stain kiln schedule as listed in the following table.

| Normal Schedule: | | |
|---|---|---|
| Moisture Content (%) | Dry Bulb Temp. (°F.) | Wet Bulb Temp. (°F.) |
| Above 40 | 150 | 140 |
| 40–35 | 150 | 136 |
| 35–30 | 150 | 130 |
| 30–25 | 160 | 135 |
| 25–20 | 160 | 130 |
| 20–15 | 170 | 135 |
| 15–7 | 180 | 135 |

| Anti-brown stain schedule: | | |
|---|---|---|
| Moisture Content (%) | Dry Bulb Temp. (°F.) | Wet Bulb Temp. (°F.), no spray |
| Above 100 | 120 | 105 |
| 100–85 | 120 | 105 |
| 85–60 | 120 | 100 |
| 60–45 | 130 | 105 |
| 45–30 | 130 | 100 |
| 30–25 | 140 | 105 |
| 25–20 | 150 | 115 |
| 20–15 | 160 | 125 |
| 15–7 | 180 | 152 |

Six kiln sample boards were weighed daily to monitor drying progress and make schedule changes. The boards were assigned a stain rating in one of the following categories based on the extent of the brown stain.

0—no stain
1—less than 25% of the surface stained
2—25–50% of the surface stained
3—over 50% of the surface stained All of the treatments in this example reported good control of brown stain with the mild kiln schedule. The six kiln sample boards provided some information on the timing of the brown stain development because they were observed daily during the 119 hours of drying with the normal schedule and the 142 hours with the anti-brown stain schedule. Brown stain was observed in the kiln sample boards dried with the normal schedule in the first weighing, which was 20 hours after start-up. No brown stain was observed with the anti-brown stain schedule until after the last step of 180° F.

The composition of the present invention is useful in preventing the brown stain of eastern white pine, radiata pine of New Zealand, and pine and hemlock of Canada. It can also be used to prevent non-microbial stain in logs and is suitable for broad spectrum biocide for anti-fungal use in pulp paper, on wood, and on brightening cellulosic substrates.

It is seen that the novel composition of the invention present a means of unexpectedly achieving almost total protection from brown stain during conditions favorable to stain development.

Having described the invention in detail and by reference to preferred embodiments thereof, it will be apparent that modifications and variations are possible without departing from the scope of the invention defined in the appended claims.

What is claimed is:

1. A method for controlling non-microbial brown stain in light-colored conifers comprising the steps of:

treating light-colored conifers with an aqueous dispersion of chlorothalonil and methylene bis-thiocyanate; and drying said light-colored conifers, thereby controlling the formation of brown stain in said light-colored conifers.

2. The method of claim 1 wherein said step of treating light-colored conifers with a dispersion includes a step of dipping said light-colored conifers in said dispersion.

3. The method of claim 1 wherein said light-colored conifers is treated for a period of about 5 seconds to one hour.

4. The method of claim 1 wherein said step of treating light-colored conifers with a dispersion includes a step of spraying said light-colored conifers with said solution.

5. The method of claim 1 wherein said step of treating light-colored conifers with a dispersion includes the step of pressure treating said light-colored conifers.

6. The method of claim 1 wherein said dispersion comprises about 13.77 to 15.23% chlorothalonil and about 13.96 to 15.44% methylene bis-thiocyanate.

7. The method of claim 1 wherein said step of drying said light-colored conifers includes the step of stacking said light-colored conifers.

* * * * *